United States Patent [19]

Tarancon

[11] 4,349,358

[45] Sep. 14, 1982

[54] METHOD OF MIXING A GAS AND A VAPORIZABLE LIQUID

[75] Inventor: Gregorio Tarancon, Woodbridge, N.J.

[73] Assignee: Union Carbide Corporation, Danbury, Conn.

[21] Appl. No.: 247,947

[22] Filed: Mar. 26, 1981

[51] Int. Cl.[3] ..... B01D 47/00

[52] U.S. Cl. ..... 55/89; 137/7; 164/526; 252/182; 261/151; 261/152

[58] Field of Search ..... 261/141, 157, 152, 151, 261/DIG. 65; 55/80, 90, 42, 89; 137/7; 164/526, 525; 252/182

[56] References Cited

U.S. PATENT DOCUMENTS

| | | | |
|---|---|---|---|
| 1,817,667 | 8/1931 | Blau | 55/42 |
| 3,399,511 | 9/1968 | Geiringer | 261/152 |
| 3,496,702 | 2/1970 | Carel et al. | 55/67 |
| 3,590,902 | 7/1971 | Walker et al. | 164/526 |
| 3,788,825 | 1/1974 | Arenson | 137/7 |
| 3,880,622 | 4/1975 | Howell | 261/152 |
| 3,931,684 | 1/1976 | Turnbull et al. | 34/242 |
| 4,070,424 | 1/1978 | Olson et al. | 55/5 |
| 4,166,799 | 9/1979 | Giacobbe | 252/182 |
| 4,276,243 | 1/1981 | Partus | 261/DIG. 65 |

FOREIGN PATENT DOCUMENTS 1402355 8/1975 United Kingdom .

*Primary Examiner*—Bernard Nozick
*Attorney, Agent, or Firm*—Saul R. Bresch

[57] ABSTRACT

A method of mixing a gas and a vaporizable liquid to provide a gaseous mixture having a constant composition, regardless of change in rate of flow, except as hereinafter provided, comprising:

(a) introducing a mixture comprising a gas and a vaporizable liquid in predetermined proportions into the tube side of a tube and shell heat exchanger at a flow rate sufficient to cause turbulent flow;

(b) introducing a heating fluid into the shell side of the heat exchanger at a temperature sufficient to vaporize at least part of the vaporizable liquid whereby the vaporizable liquid separates into a vapor phase and a liquid phase; and (c) delivering the mixture of gas and vapor phase to a use point and recycling the liquid phase to a point at which it will be mixed with gas for introduction into step (a).

6 Claims, 1 Drawing Figure

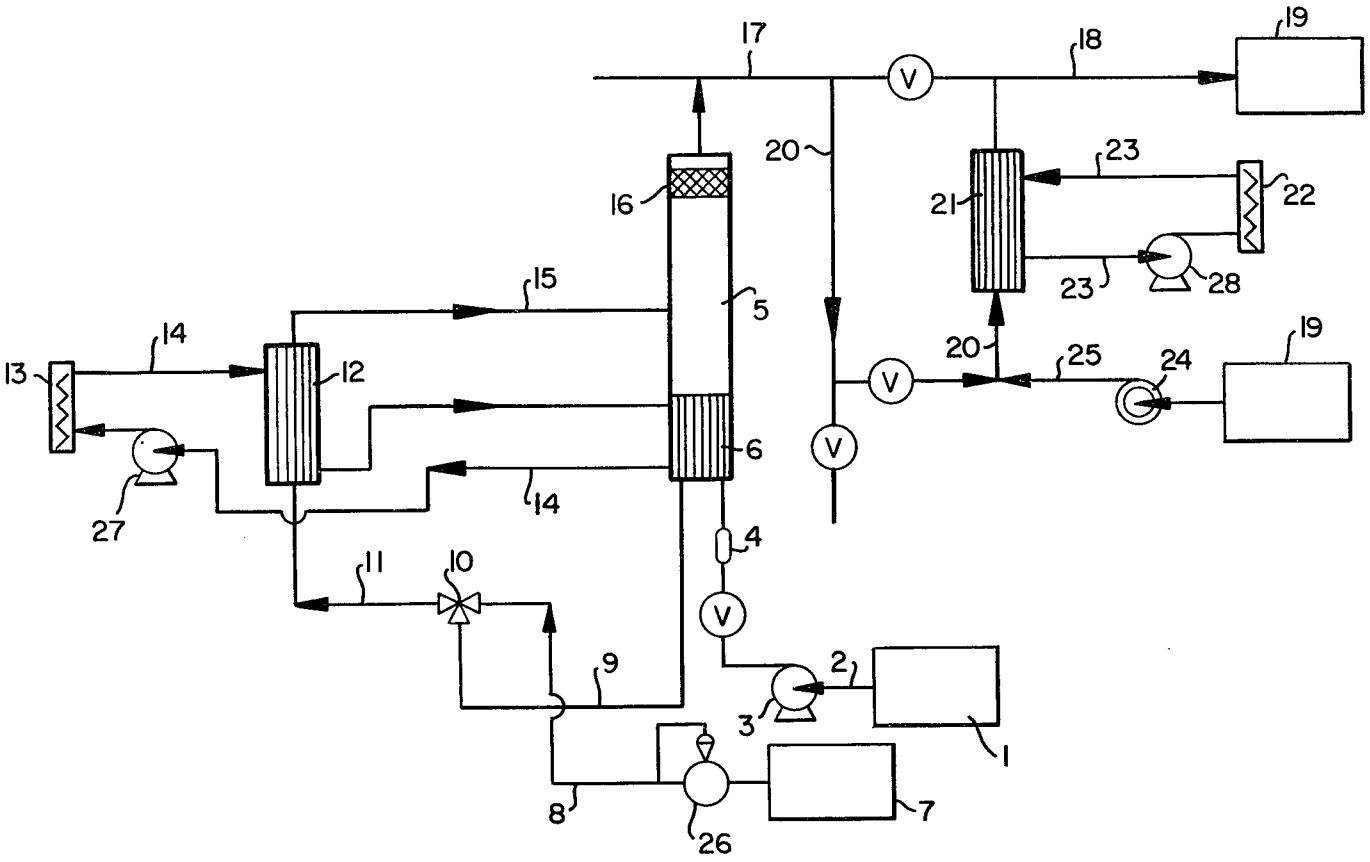
19
22
28
23
23
18
21
20
17
20
19
24
25
1
2
3
7
26
5
6
4
16
9
8
15
14
10
11
12
14
27
13

METHOD OF MIXING A GAS AND A VAPORIZABLE LIQUID

FIELD OF THE INVENTION

This invention concerns the mixing of a gas and a vaporizable liquid for the purpose of providing a gaseous mixture at a use point.

DESCRIPTION OF THE PRIOR ART

There are numerous commercial applications which require that a gas be mixed with a vaporizable liquid in order to deliver a gaseous mixture to a particular destination.

One of these applications involves the making of sand cores, which are utilized as casting molds in foundries. Sand cores may be made by mixing sand with a polymerizable resin and introducing the mixture into a molding cavity. An amine catalyst/carrier gas mixture is then injected into the cavity, and the catalyst causes the resin to polymerize and bind the sand forming a self-supporting core.

Another application involves electrostatic precipitation, a technique for the removal of particulates from stack waste gases. Coal fired power plants require a large amount of particulate removal from their stack waste gases before the gases can be vented into the atmosphere. The efficiency of electrostatic precipitation, a common method of removal, is greatly improved if the polluted gas is mixed with an amine gas before passing to the precipitator.

The amines used in the sand core process and in conjunction with electrostatic precipitation are vaporizable liquids. Generally, they are needed in small amounts; however, spraying these liquids into carrier gases or process gas streams, even in these small concentrations, yields a non-uniform, poorly mixed composition, which results in poor process performance. The problem appears to lie in the lack of constancy in the flow rate of the carrier gas.

Present blending techniques, which are designed to work well at fixed flow rates, i.e., designs resulting in a constant coefficient of gas-liquid contact independent of gas rate, are poorly suited for accommodating variable flow rates.

SUMMARY OF THE INVENTION

An object of this invention, therefore, is to provide an improvement in known blending processes whereby constant vapor concentration in a carrier gas is achieved in spite of variations in flow rate.

Other objects and advantages will become apparent hereinafter.

A method of mixing a gas and a vaporizable liquid has not been discovered which provides a gaseous mixture having a constant composition, regardless of change in rate of flow, except as hereinafter provided. This method comprises:

(a) introducing a mixture comprising a gas and a vaporizable liquid in predetermined proportions into the tube side of a tube and shell heat exchanger at a flow rate sufficient to cause turbulent flow (as opposed to laminar flow);

(b) introducing a heating fluid into the shell side of the heat exchanger at a temperature sufficient to vaporize at least part of the vaporizable liquid whereby the vaporizable liquid separates into a vapor phase and a liquid phase; and (c) delivering the mixture of gas and vapor phase to a use point and recycling the liquid phase to a point at which it will be mixed with gas for introduction into step (a).

A particular application of this process to the preparation of sand cores is defined as follows:

a process for delivering a gaseous mixture of nitrogen and triethylamine to a use point, e.g., a foundry mold curing station where the amine acts as a catalyst in the polymerization of a resin binder causing a sand/resin binder mixture to harden, comprising:

(a) mixing nitrogen gas and liquid triethylamine in an aspirator;

(b) passing the mixture through the tube side of a heat exchanger wherein the mixture is heated to a predetermined temperature at a predetermined pressure and the liquid amine separates into a vapor phase and a liquid phase, the flow rate being sufficient to cause turbulence;

(c) passing the mixture from step (b) into a zone wherein the liquid amine falls to the bottom and is recycled to step (a) and the gaseous mixture of nitrogen and amine rises to the top and passes through a demister wherein entrained droplets of liquid amine are removed from the gaseous mixture and returned to the bottom of the zone;

(d) passing the gaseous mixture of nitrogen and amine to the use point when the use point is in operation; and (e) when the use point is not in operation, continuously recirculating the gaseous mixture through a heat exchanger whereby the mixture is maintained in the gaseous state and condensation is essentially avoided.

BRIEF DESCRIPTION OF THE DRAWING

The sole FIGURE of the drawing is a schematic diagram of a flow sheet showing the process of the invention as applied to the delivery of amine catalyst to a foundry mold curing station.

DESCRIPTION OF THE PREFERRED EMBODIMENT

The gaseous mixture, which is sought by subject process, is a blend of a gas and a vaporizable liquid in vapor form. The gas component is generally one or a mixture of gases inert to the vaporizable liquid and usually to the process components also. A common carrier gas is nitrogen, but the use of other conventional carrier gases such as argon, helium, and carbon dioxide is contemplated.

The vaporizable liquid is also, of course, inert insofar as the carrier gas is concerned, but is generally a component of the process, which is being effected at the use point to which the blend is being delivered, either as a reactant or catalyst, or having some other process function. Examples of vaporizable liquids used as catalysts in foundry mold curing are triethylamine and dimethylethylamine. Other vaporizable liquids which might be blended using subject process are ethylamine, diethylamine, dimethylamine, trimethylamine, and ethanol.

Flow rates can range from those sufficient to cause turbulent flow in the tube side of a tube and shell heat exchanger to about 100 standard cubic feet per minute (SCFM) and are preferably in the range of about 10 SCFM to about 100 SCFM. Process temperatures can range from about 20° C. to about 120° C. and are preferably in the range of about 30° C. to about 90° C. Process pressures can be in the range of about 0 psig to about 100 psig and are usually about 15 psig to about 60 psig. Once the pressure for the system is set, it is usually kept constant.

Referring to the drawing:

A vaporizable liquid, such as one of the amines mentioned above, is stored in reservoir 1. It is pumped through line 2 using pump 3, which is preferably a magnetic drive liquid pump to avoid leakage at pump seals. The liquid continues along line 2 through filter 4 in order to remove any impurities and passes into tank 5 and then to heat exchanger 6, which is located at the bottom of tank 5. From heat exchanger 6, the amine proceeds along line 9 until it reaches aspirator 10 (a mixing-type aspirator).

The carrier gas, e.g., nitrogen, is kept in reservoir 7. The nitrogen passes along line 8 through pre-set regulator 26 to aspirator 10 where the amount of liquid amine drawn by the nitrogen gas flow is proportional to the rate of gas flow. The gas/liquid mixture proceeds through line 11 to the tube side of heat exchanger 12. To achieve turbulent flow (as opposed to laminar flow) in the tube side of heat exchanger 12, the flow of nitrogen is kept constant while the flow (pounds per hour) of the liquid is increased until turbulence is obtained. The BTU's per pound of gas/liquid mixture is also kept constant after the temperature of the heating fluid is adjusted to provide for the vaporization of about 5 to about 10 percent by weight of the liquid. The heating fluid, which passes through heater 13, line 14, pump 27, and the shell side of heat exchangers 12 and 6, is heated by heater 13. A resistance type or other conventional heater can be used here or for heater 22 and a conventional heating fluid such as a water/glycol antifreeze mixture can also be used. The temperature of the heating fluid is preferably in the range of about 40° C. to about 90° C.

The size and number of the tubes in the tube side of heat exchanger 12 can be changed to increase efficiency. The maximum flow rate to be used in a particular system is first determined. Then, the number of tubes of a particular size is selected to give that flow rate, bearing in mind that one should use tubes of the smallest cross-sectional area, which will give the maximum flow, and that the use of a relatively fewer number of tubes or tubes of smaller cross-sectional area will generally result in higher velocities, which will cause turbulence at lower flow rates. While in many applications oversizing of heat exchangers is commonly practiced, in subject process, sizing is preferably no greater than that needed to achieve maximum flow. A typical heat exchanger used in this process may have 100 to 120 tubes each with an internal diameter of one quarter inch. The proportion of gas to liquid as the mixture enters heat exchanger 12 is preferably kept constant as is the level of liquid amine in tank 5.

The turbulence of the two phase flow through the tube side of heat exchanger 12 coupled with the controlled heating fluid temperature to the shell side causes the heat input to increase in proportion to the gas flow. Increasing flow causes increasing turbulence in the thin heat exchanger tubes resulting in an increased overall heat transfer coefficient in heat exchanger 12, i.e., the rate of heat passing to the gas/liquid mixture in the tube side increases with greater turbulence in the tube side. As noted, part of the liquid amine is vaporized here, the amount vaporized preferably being at least sufficient to saturate the nitrogen gas. The balance of the amine remains as a liquid. As long as the temperature in heater 13, the system pressure, and the weight ratio of gas to liquid at aspirator 10 remain the same, the composition of the nitrogen gas/amine vapor mixture entering line 15 will remain the same regardless of change in rate of flow.

When the gaseous mixture of nitrogen and amine is drawn through line 18 at use point 19, e.g., a foundry mold curing station where the amine acts as a catalyst in the polymerization of a resin binder causing a sand/resin binder mixture to harden, the pressure regulator (not shown) on line 17 opens letting the mixture flow along line 20 through heat exchanger 21, which compensates for any temperature loss by expansion through the regulator, as well as raising the temperature well above the mixture dew point to minimize anine condensation in process lines and allowing for heat losses in lines 17, 20, and 18.

This action causes a pressure drop in the system opening the pressure regulator (not shown) on line 8, which permits nitrogen to flow through aspirator 10. Here, the nitrogen draws a proportional amount of liquid amine into line 11 and the gas/liquid mixture flows through line 11 to heat exchanger 12. Heat exchanger 12 is preferably vertically mounted so that the gas/liquid mixture flows upward through the tube side. In heat exchanger 12, as previously described, the mixture is heated to process temperature and a fraction of the amine is vaporized, saturating the nitrogen gas. The gaseous mixture of nitrogen and amine together with the unvaporized liquid amine, then, flow through line 15 to about the center of tank 5 which is maintained under a pressure of about 15 psig to about 60 psig. Tank 5 contains demister (or phase separator) 16 at the top and heat exchanger 6 at the bottom. Liquid amine is maintained above heat exchanger 6, but preferably below the midpoint of tank 5. Free liquid amine flows down into the pool of liquid amine where it joins liquid amine coming from reservoir 1. The gaseous mixture together with entrained liquid amine passes upward to demister 16 where the entrained liquid is removed and falls to the bottom of tank 5 to join the rest of the liquid amine. Demister 16 is conventional and can be described, for example, as a roll or bundle of stainless steel wire mesh having a height of six inches and a diameter the same as tank 5. The larger the tank, the larger the diameter and, conversely, the smaller the tank, the smaller the diameter. The level of the liquid amine in tank 5 is measured by a level sensor (not shown) placed at the side of tank 5. This sensor controls metering pump 3 supplying the amine from reservoir 1, which can be a tank, drum, or cylinder. The liquid amine is maintained at a level just below that of inlet line 15. In a typical application, the level is permitted to fall three inches. The level sensor then turns on pump 3 until the three inches of liquid amine is restored and then the level sensor turns the pump off.

Heat exchanger 6 can be a calandria-type heat exchanger bundle. Its function is to keep the liquid amine at a minimum temperature at all times, e.g., in the range of about 30° C. to about 90° C., thus reducing the demand on heat exchanger 12 and allowing almost instantaneous start-up after long inactive periods. As noted previously, the heating fluid for heat exchanger 6 comes through line 14 after passing through heat exchanger 12.

Thermocouples (not shown) are preferably inserted in the headspace of heat exchanger 12 and heat exchanger 21 to control heaters 13 and 22, respectively, and in the heating fluid to activate a high temperature shut-off (also not shown), thus preventing overheating of the liquid, which might damage the heaters. The indirect heating of the amine by a secondary fluid virtually eliminates the explosion hazard which could arise from amine contacting a red hot heating element.

A nitrogen/amine gas recycle system is provided for to keep the gaseous mixture flowing when use point 19 is shut down. By constantly circulating and heating the gas, process lines are always maintained at operating temperature, pressure, and composition allowing instantaneous start-up, and eliminating the long delays presently encountered while waiting for the system to come up to operating conditions.

Recycle pump 24 draws or pushes the process gas from the manifold (not shown) at use point 19 through lines 25 and 20 and into heat exchanger 21 where it is reheated and returned to the use point manifold. Typically, a flow rate of about 30 to about 40 standard cubic feet per minute (SCFM) is maintained. During normal operation the flow rate is sufficient to prevent condensation of the amine in the pipeline. During shutdown or low use periods, however, the recycle system assures proper delivery temperature and composition on demand. The heating fluid supplied to heat exchanger 21 is heated in heater 22 and recirculated through line 23 with the assistance of pump 28.

The apparatus which may be used to provide the function of recycle pump 24 are, in order of preference, a magnetic-drive vane blower; a double-sealed compressor; and a jet pump using liquid amine as a motive force pumped by a high-level magnetic drive pump.

Recycle pump 24 should be completely sealed as even a small amount of amine leakage constitutes a severe nuisance and a potential health and explosion hazard. Therefore, conventionally sealed liquid pumps or blowers are inadequate for this duty as small amounts of leakage from around the shaft seals are inevitable. This contraint suggests either seal-less magnetic drive units or a double-seal compressor designed for this service.

The following examples illustrate the invention.

EXAMPLES 1 to 6

The examples are run according to the above steps and conditions in the apparatus described above and in the drawing.

Tank 5 is filled to the operating level (just below line 15) with vaporizable liquid from reservoir 1, which is placed on a scale to permit weighing of the liquid consumed in the process. In examples 1 to 4, triethylamine is used as the vaporizable liquid and in examples 5 and 6, ethanol is used. The carrier gas used in all examples is nitrogen. In each example, two 15 minute runs are made at each of four nitrogen flow rates. Saturation of gas with liquid is achieved in each run.

Constant conditions for all examples with regard to flow of nitrogen to aspirator 10 are as follows:

| Run | SCFM | Pound per Minute | Pound-mol per minute |
|---|---|---|---|
| (1) | 18 | 1.30 | 0.047 |
| (2) | 18 | 1.30 | 0.047 |
| (3) | 36 | 2.61 | 0.093 |
| (4) | 36 | 2.61 | 0.093 |
| (5) | 54 | 3.91 | 0.140 |
| (6) | 54 | 3.91 | 0.140 |
| (7) | 72 | 5.22 | 0.186 |

-continued

| Run | SCFM | Pound per Minute | Pound-mol per minute |
|---|---|---|---|
| (8) | 72 | 5.22 | 0.186 |

Constant conditions for each example are as follows:

| Example | 1 | 2 | 3 | 4 | 5 | 6 |
|---|---|---|---|---|---|---|
| Temperature in tank 5 (°C.) | 38 | 40 | 45 | 50 | 27 | 44 |
| Pressure in tank 5 (psia) | 30 | 60 | 45 | 75 | 30 | 60 |
| Temperature in heat exchanger 21 (°C.) | 45 | 50 | 55 | 60 | 45 | 60 |
| Recycle flow rate (SCFM) (This is the flow passing through use point 19, line 25, pump 24, line 30, heat exchange 21, and line 18) | 18 | 25 | 21 | 28 | 19 | 25 |
| Theoretical molar concentration of liquid in gas exiting heat exchanger 12 along line 15 | 8.0 | 4.5 | 7.4 | 5.4 | 4.4 | 5.2 |

Constant conditions for each example with regard to flow of triethylamine or ethanol to aspirator 10 together with mol percent and percent deviation, both calcualted and analyzed, are as follows:

EXAMPLE 1

| | | | | Calculated | | Analyzed | |
|---|---|---|---|---|---|---|---|
| Run | pounds | pounds per minute | pound-mol per minute | mol percent | percent deviation | mol percent | percent deviation |
| (1) | 5.80 | 0.387 | 0.0038 | 7.48 | 6.5 | 7.6 | 5.0 |
| (2) | 6.10 | 0.407 | 0.0040 | 7.8 | 2.0 | 7.8 | 2.5 |
| (3) | 12.60 | 0.840 | 0.0083 | 8.2 | −2.4 | 8.2 | −2.5 |
| (4) | 12.00 | 0.800 | 0.0079 | 7.8 | 2.1 | 7.9 | 1.3 |
| (5) | 18.60 | 1.24 | 0.0123 | 8.1 | 1.0 | 8.1 | −1.3 |
| (6) | 19.20 | 1.28 | 0.0126 | 8.3 | 3.2 | 8.2 | −2.5 |
| (7) | 25.20 | 1.68 | 0.0166 | 8.2 | −2.4 | 8.2 | −2.5 |
| (8) | 25.20 | 1.68 | 0.0166 | 8.2 | −2.4 | 8.1 | −1.3 |

EXAMPLE 2

| | | | | Calculated | | Analyzed | |
|---|---|---|---|---|---|---|---|
| Run | pounds | pounds per minute | pound-mol per minute | mol percent | percent deviation | mol percent | percent deviation |
| (1) | 3.30 | 0.223 | 0.0022 | 4.47 | 0.6 | 4.5 | 0.0 |
| (2) | 3.20 | 0.213 | 0.0021 | 4.28 | 5.0 | 4.3 | 4.4 |
| (3) | 6.80 | 0.455 | 0.0045 | 4.62 | −2.6 | 4.7 | −4.4 |
| (4) | 6.80 | 0.455 | 0.0045 | 4.62 | −2.6 | 4.6 | −2.2 |
| (5) | 10.00 | 0.668 | 0.0066 | 4.50 | 0 | 4.5 | 0.0 |
| (6) | 10.30 | 0.688 | 0.0068 | 4.63 | −2.9 | 4.6 | −2.2 |
| (7) | 13.50 | 0.901 | 0.0089 | 4.57 | −1.5 | 4.6 | −2.2 |
| (8) | 13.40 | 0.891 | 0.0088 | 4.52 | −0.4 | 4.6 | −2.2 |

EXAMPLE 3

| Run | pounds | pounds per minute | pound-mol per minute | Calculated mol percent | Calculated percent deviation | Analyzed mol percent | Analyzed percent deviation |
|---|---|---|---|---|---|---|---|
| (1) | 5.80 | 0.387 | 0.0038 | 7.48 | −1.1 | 7.4 | 0.0 |
| (2) | 6.10 | 0.407 | 0.0040 | 7.84 | −6.0 | 7.8 | −5.4 |
| (3) | 11.50 | 0.767 | 0.0076 | 7.55 | −2.1 | 7.6 | −2.7 |
| (4) | 11.20 | 0.747 | 0.0074 | 7.37 | 0.4 | 7.5 | −1.4 |
| (5) | 17.20 | 1.147 | 0.0113 | 7.47 | −0.9 | 7.4 | 0.0 |
| (6) | 17.20 | 1.147 | 0.0113 | 7.47 | −0.9 | 7.5 | −1.4 |
| (7) | 22.90 | .527 | 0.0151 | 7.51 | −1.5 | 7.5 | −1.4 |
| (8) | 22.60 | 1.507 | 0.0149 | 7.42 | −0.2 | 7.4 | 0.0 |

EXAMPLE 4

| Run | pounds | pounds per minute | pound-mol per minute | Calculated mol percent | Calculated percent deviation | Analyzed mol percent | Analyzed percent deviation |
|---|---|---|---|---|---|---|---|
| (1) | 4.10 | 0.273 | 0.0027 | 5.43 | −0.6 | 5.5 | −1.9 |
| (2) | 4.00 | 0.267 | 0.0026 | 5.24 | 2.9 | 5.3 | 1.9 |
| (3) | 8.20 | 0.547 | 0.0054 | 5.49 | −1.6 | 5.5 | −1.9 |
| (4) | 8.40 | 0.560 | 0.0055 | 5.58 | −3.4 | 5.5 | −1.9 |
| (5) | 12.30 | 0.820 | 0.0081 | 5.47 | −1.3 | 5.5 | −1.9 |
| (6) | 12.10 | 0.807 | 0.0080 | 5.41 | −0.1 | 5.4 | 0.0 |
| (7) | 16.40 | 1.093 | 0.0108 | 5.49 | −1.6 | 5.5 | −1.9 |
| (8) | 16.10 | 1.073 | 0.0106 | 5.39 | 0.2 | 5.4 | 0.0 |

EXAMPLE 5

| Run | pounds | pounds per minute | pound-mol per minute | Calculated mol percent | Calculated percent deviation | Analyzed mol percent | Analyzed percent deviation |
|---|---|---|---|---|---|---|---|
| (1) | 1.60 | 0.107 | 0.0023 | 4.67 | −6.0 | 4.6 | −4.5 |
| (2) | 1.50 | 0.100 | 0.0022 | 4.47 | −1.6 | 4.5 | −2.3 |
| (3) | 3.00 | 0.200 | 0.0043 | 4.42 | −0.4 | 4.4 | 0.0 |
| (4) | 3.00 | 0.200 | 0.0043 | 4.42 | −0.4 | 4.3 | 2.3 |
| (5) | 4.40 | 0.293 | 0.0064 | 4.37 | 0.6 | 4.4 | 0.0 |
| (6) | 4.50 | 0.300 | 0.0065 | 4.44 | −0.8 | 4.4 | 0.0 |
| (7) | 6.00 | 0.400 | 0.0087 | 4.47 | −1.6 | 4.5 | −2.3 |
| (8) | 6.10 | 0.407 | 0.0088 | 4.52 | −2.7 | 4.5 | −2.3 |

EXAMPLE 6

| Run | pounds | pounds per minute | pound-mol per minute | Calculated mol percent | Calculated percent deviation | Analyzed mol percent | Analyzed percent deviation |
|---|---|---|---|---|---|---|---|
| (1) | 1.80 | 0.120 | 0.0026 | 5.24 | −0.8 | 5.2 | 0.0 |
| (2) | 1.80 | 0.120 | 0.0026 | 5.24 | −0.8 | 5.3 | −1.9 |
| (3) | 3.50 | 0.233 | 0.0051 | 5.20 | 0.0 | 5.2 | 0.0 |
| (4) | 3.60 | 0.240 | 0.0052 | 5.3 | −1.8 | 5.4 | −3.8 |
| (5) | 5.20 | 0.347 | 0.0075 | 5.08 | 2.2 | 5.1 | 1.9 |
| (6) | 5.40 | 0.360 | 0.0078 | 5.28 | −1.5 | 5.3 | −1.9 |
| (7) | 7.1 | 0.473 | 0.0103 | 5.25 | −0.9 | 5.2 | 0.0 |
| (8) | 7.0 | 0.467 | 0.0101 | 5.15 | 1.0 | 5.2 | 0.0 |

the above calculations are made as follows:

$A$ = molecular weight of nitrogen = 28.01

$B$ = molecular weight of triethylamine = 101.19

$B$ = molecular weight of ethanol = 46.07

$C$ = 13.8 standard cubic feet per pound $D$ = vapor pressure of liquid as a function of temperature $E$ = time of run = 15 minutes $F$ = flow rate of nitrogen in standard cubic feet per minute (SCFM)

$G$ = weight of liquid used in pounds per E $H$ = concentration of liquid in gas read by analyzer $P$ = pressure in tank 5

$I$ = pounds per minute of nitrogen = the mass flow rate of nitrogen = $F/C = F/13.8$ $J$ = pound-mol per minute of nitrogen = the molar flow rate of nitrogen = $F/(A \times C) = F/(28.01 \times 13.8)$ $K$ = pounds per minute of liquid = the mass flow rate of the liquid = $G/E = G/15$ $L$ = pound-mol per minute of liquid = the molar flow rate of liquid = $G/(E \times B) = G/(15 \times B)$ $M$ = total molar flowrate = pound-mol per minute of nitrogen plus pound-mol per minute of liquid = $J + L$.

$N$ = mol percent (calculated) = molar concentration of liquid in gas exiting heat exchanger 12 along line 15 = the molar flowrate of liquid divided by the total molar flowrate =

$$\left(\frac{G}{E \times B}\right) \div \left(\frac{F}{A \times C} + \frac{G}{E \times B}\right) \times 100$$

$Q$ = theoretical molar concentration of liquid in gas exiting heat exchanger 12 along line 15 = $(D/P) \times 100$ $R$ = percent deviation (calculated) of molar concentration of liquid in gas =

$$\frac{Q - H}{Q} \times 100$$

$S$ = percent deviation (analyzed) of molar concentration of liquid in gas =

$$\frac{Q - N}{Q} \times 100$$

I claim:

1. A method of mixing a gas and a vaporizable liquid to provide a gaseous mixture having a constant composition, regardless of change in rate of flow, except as hereinafter provided, comprising:

(a) admixing the gas and the vaporizable liquid in predetermined proportions;

(b) introducing the mixture of step (a) at a predetermined pressure into the tube side of a tube and a shell heat exchanger at a flow rate sufficient to cause turbulent flow;

(c) introducing a heating fluid into the shell side of the heat exchanger at a temperature sufficient to vaporize at least part of the vaporizable liquid, separating the vaporizable liquid into a vapor phase and a liquid phase; and (d) delivering the mixture of gas and vapor phase to a use point and recycling the liquid phase to step (a).

2. The method defined in claim 1 wherein, in step (b), the gas is saturated with the vapor of the vaporizable liquid.

3. The method defined in claim 1 wherein, in step (b), about 5 to about 10 percent by weight of the liquid amine is converted to the vapor phase.

4. A process for delivering a gaseous mixture of nitrogen and triethylamine to a use point comprising:

(a) mixing nitrogen gas and liquid triethylamine in an aspirator;

(b) passing the mixture through the tube side of a heat exchanger wherein the mixture is heated to a predetermined temperature and the liquid amine separates into a vapor phase and a liquid phase, the flow rate being sufficient to cause turbulence;

(c) passing the mixture from step (b) into a pressurized zone wherein the liquid amine falls to the bottom of the zone and is recycled to step (a) and the gaseous mixture of nitrogen and amine rises to the top and passes through a demister wherein entrained droplets of liquid amine are removed from the gaseous mixture and returned to the bottom of the zone;

(d) passing the gaseous mixture of nitrogen and amine to the use point when the use point is in operation; and (e) when the use point is not in operation, continuously recirculating the gaseous mixture through a heat exchanger whereby the mixture is maintained in the gaseous state and condensation is essentially avoided.

5. The process defined in claim 4 wherein, in step (b), the nitrogen gas is saturated with amine vapor.

6. The process defined in claim 4 wherein, in step (b), about 5 to about 10 percent by weight of the liquid amine is converted to the vapor phase.

* * * * *